United States Patent [19]

Inayama et al.

[11] 4,339,647

[45] Jul. 13, 1982

[54] DUAL FAN MEANS FOR HEATING CHAMBER OF MICROWAVE COOKING DEVICE

[75] Inventors: Minoru Inayama, Komaki; Hideyuki Hamanaka, Konan, both of Japan

[73] Assignee: Rinnai Kabushiki Kaisha, Fukuzumu, Japan

[21] Appl. No.: 142,371

[22] Filed: Apr. 17, 1980

[30] Foreign Application Priority Data

Apr. 24, 1979 [JP] Japan ..... 54/54117[U]

[51] Int. Cl.[3] ..... H05B 6/64

[52] U.S. Cl. ..... 219/10.55 R; 219/10.55 F

[58] Field of Search ..... 219/10.55 R, 10.55 F, 219/10.55 M, 10.55 A

[56] References Cited

U.S. PATENT DOCUMENTS

| | | | |
|---|---|---|---|
| 2,860,026 | 11/1958 | Long | 219/10.55 B |
| 4,097,709 | 6/1978 | Bächtold et al. | 219/10.55 R |
| 4,211,909 | 7/1980 | Yoshida et al. | 219/10.55 R |

FOREIGN PATENT DOCUMENTS

| | | | |
|---|---|---|---|
| 49-34440 | 3/1974 | Japan | 219/10.55 R |
| 50-89364 | 2/1977 | Japan | 219/10.55 R |
| 52-67563 | 6/1977 | Japan | 219/10.55 F |

*Primary Examiner*—Arthur T. Grimley
*Attorney, Agent, or Firm*—Leonard Bloom

[57] ABSTRACT

A microwave cooking device having a main body provided therein with a heating chamber adapted for receiving foodstuffs to be cooked, a magnetron for irradiating microwave energy onto the interior of the heating chamber, and an air charging and discharging fan for forcing air to charge into and out of the heating chamber, such charging and discharging occurring through an air charging opening disposed in the heating chamber, the invention characterized in that a circulation fan for circulating air within the heating chamber is provided within the heating chamber in a fashion such that said fan is connected to a shaft common to both the air charging and air discharging fan.

12 Claims, 5 Drawing Figures

DUAL FAN MEANS FOR HEATING CHAMBER OF MICROWAVE COOKING DEVICE

BACKGROUND OF THE INVENTION

The present invention relates to a microwave cooking device of a type in which cooking by microwave is carried out by irradiation from a magnetron onto the interior of a heating chamber provided in the main body of a cooking device.

There have been hitherto known cooking devices of this kind in that, to enable water vapor steaming from foodstuffs to be cooked during cooking of the same by the microwave, and prevention of the water vapors from becoming condensed into water droplets in the heating chamber, there have been provided an air charging and discharging fan which forces air into and discharges air from the heating chamber for carrying away water vapors to the exterior of the chamber. It has been usual with this type of device that air-charging opening and an air discharging opening is disposed in the heating chamber, and that such opening is comparatively small as to prevent any leakage of microwave radiation. As such, considerable inconvenience has been involved inasmuch as, by operation of the air charging discharging fan, there is produced a charging and discharging air current flowing through a limited portion of the whole interior space of the heating chamber and, consequently, a part of the vapors are not subjected to the action of the air current and, therefore, the vapors become stagnanted in the chamber so that water droplets are liable to be formed, the same having a resultant unfavorable effect on the cooking process.

It is the object of the present invention to provide a cooking device which is free of the foregoing limitation of operation and function.

SUMMARY OF THE INVENTION

The present invention comprises a microwave cooking device of the type having a cooking device main body provided therein with a heating chamber for receiving a foodstuff to be cooked, a magnetron for radiating microwaves onto the interior of the heating chamber, and an air sharging and discharging fan for forcing air to charge into and to discharge from the heating chamber, said charging discharging occurring through an air charging opening and an air discharging opening disposed within the said heating chamber, the invention characterized in that a circulation fan for circulating air in said chamber is provided in the heating chamber in a manner such that the fan is connected to a shaft which is common to both the air charging and the air discharging fan.

DETAILED DESCRIPTION OF INVENTION

Figure 1:
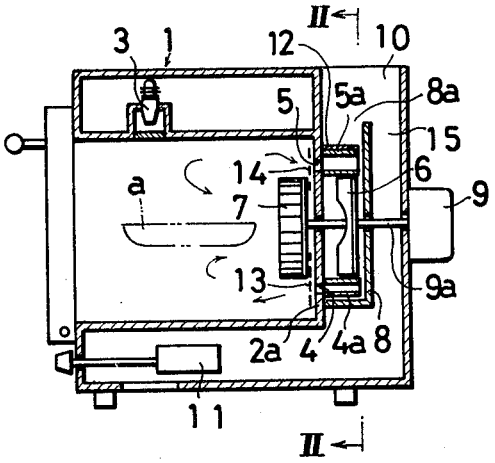
FIG. 1 is a sectional side view taken along line 1—1 of FIG. 2, the same illustrating one embodiment of the present invention.

In a cooking device of the type that a cooking device main body 1 is provided therein with a heating chamber 2 for receiving foodstuff a to be cooked there is provided a magnetron 3 for irradiating microwaves into the interior of the heating chamber 2, and an air charging and discharging fan 6 for causing air to charge into and discharge from the heating chamber 2 through an air charging opening 4 and an air discharging opening 5 which are made in the heating chamber 2. The invention is characterized in that a circulation fan 7 for circulating air in the chamber is provided in the heating chamber 2 in such a manner that the same is connected to a shaft 9*a* common to the air charging and discharging fan 6.

FIG. 1 illustrates first embodiment of the invention. In this embodiment, the air charging and discharging fan 6 is positioned in a fan casing 8 attached to the outside of a rear wall 2*a* of the heating chamber 2 and is connected to a motor shaft 9*a* extending from an electric motor 9 provided on the rear wall 1*a* of the cooking device main body 1, and there is disposed in the rear wall 2*a* the air charging opening 4 on a lower side of such wall and the air discharging opening 5 on an upper side which openings are in communication with the interior of the fan casing 8.

Figure 2:
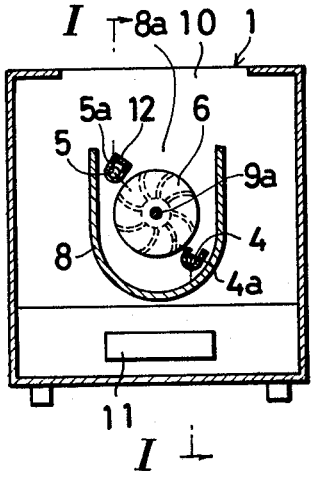
FIG. 2 is a sectional view taken along line 2—2 of FIG. 1.

Additionally, said air charging and air discharging openings 4 and 5 respectively are provided at their peripheral edges, and at the outer surface of the rear wall 2*a* of the heating chamber 2, with respective guide members 4*a* and 4*b*, as shown in FIG. 2, so that in rotation of the air charging and discharging fan 6, a positive air pressure acts on the outside of the air-charging opening 4 through the guide member 4*a* on which a guide opening is disposed in the face of the rotary direction of the fan 6, while a negative air pressure acts on the outside of the air discharging opening 5 though the guide member 5*a* of which a guide opening is directed along the rotary direction thereof.

The motor shaft 9*a* is extended into the heating chamber 2, and the circulation fan 7 is mounted thereon. By the operation of the fan 7, the air within the chamber 2 is forced to flow from the central portion of the circulation fan 7 to the periphery thereof to be circulated into the chamber 2. Consequently, a positive air pressure caused by the flowing pressure thereof acts on the air discharging opening 5, and by the cooperation of the positive air pressure with the negative air pressure, acting on the outside of the opening 5 caused by the air charging and discharging fan 6, the circulating air within the chamber 2 can be gradually discharged from the air discharging opening 5 to the exterior of the chamber. Meanwhile, due to imbalance in pressure between the interior and the exterior of the heating chamber 2, the external air of an amount, corresponding to that of the discharged air, is automatically charged through the air charging opening 4 into the heating chamber 2.

The air discharged from the air-discharging opening 5 is discharged to the external atmosphere from an exhaust opening 10 disposed in the top wall of the cooking device main body 1 and through a mouth opening 8*a* formed in the top of the fan casing 8.

Referring to FIGS. 1 and 2, numeral 11 denotes a heat source including a gas burner disposed below the heating chamber 2. It is contemplated that, besides the microwave cooking by the magnetron 3 which is provided on the top wall of the heating chamber 2, cooking by the gas heat of the heat source 11 may be carried out as desired. More particularly, in the operation of the heat source 11, there is brought about a heat cooking condition in which the air within the chamber is heated through the chamber walls of the heating chamber 2. On this occasion, the circulation fan 7, circulating air within the chamber, serves to advantageously make uniform the distribution of temperature in the chamber.

In order to prevent smoke or the like from discharging from the heating chamber 2 and from contaminating a kitchen or the like, either the air charging opening 4 or the air discharging opening 5 as, for instance, in the case of the latter is illustrated in FIGS. 1 and 2, is provided with a damper 12 arranged to be closed during the operation of the heat source 11, so that the air charging and discharging operation of the fan 6 may be selectively controlled.

Referring to FIGS. 1 and 2, numerals 13 and 14 denote safety elements for preventing leakage of the microwaves by covering the air charging opening 4 and the air discharging opening 5, respectively; numeral 15 denotes an exhaust passage for discharging hot combustion gas from the heat source 11 into the exhaust opening 10.

In operation of the magnetron 3, the damper 12 is opened. Thus, by operation of the air charging and discharging fan 6, and the circulation fan 7 as mentioned before, the external air is charged into the heating chamber 2 from the air charging opening 4, is then circulated in the chamber 2, and is gradually discharged to the exterior from the air discharging opening 5. Accordingly, there is formed an air current which flows substantially throughout the interior space of the heating chamber 2; resultingly the vapors evaporated from the foodstuff being cooked are carried away and are discharged, without remaining in the chamber 2, to the exterior by said air current and, thereby, formation of waterdrops in the chamber 2 are substantially prevented.

Figure 3:
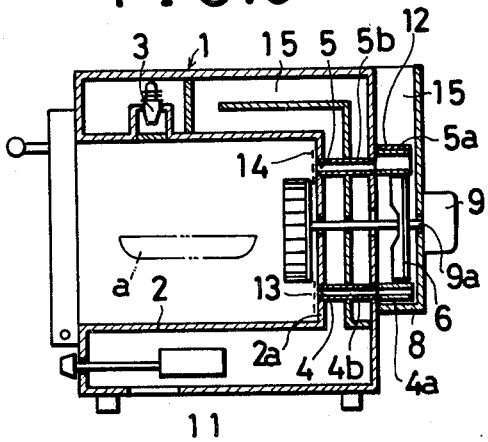
FIGS. 3 through 5 are respective sectional side views of further embodiments of the present invention.

In the above example, the air-charging and discharging fan 6 is provided in the fan casing 8 which is provided on the rear side of the heating chamber 2; however, it can be modified so that, as shown in FIG. 3, for instance, the same is provided in the exhaust passage 15 which is provided on the rear side of the cooking device main body 1 so as to thereby serve also as an exhaust fan for combustion gas. In this case, the air-charging opening 4 and the air-discharging opening 5 are in communication with the exhaust passage 15 through respective connecting tubes **4*b* and 5*b***.

Figure 5:
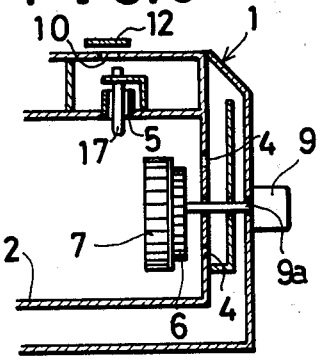
Figure 4:
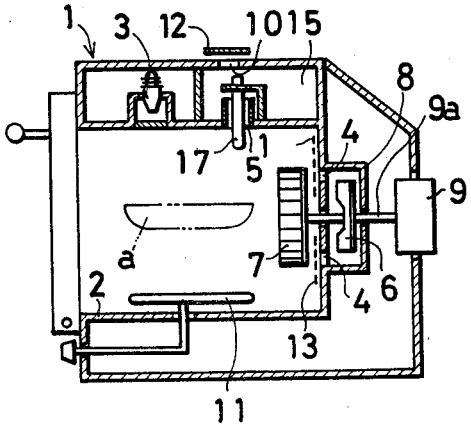

Such a modification can be also considered in that, as shown in FIG. 4, an opening for inserting a member 17, such as a temperature sensor or the like, is made in the top wall of the heating chamber 2 and is of a diameter large enough to leave a venting space between the opening and the member 17 and, thus, the space is utilized as the air discharging opening 5. This arrangement is so designed that the external air is blown into the heating chamber 2 through the air-charging openings 4 made in the rear wall **2*a* of the heating chamber 2, by the air-charging and discharging fan 6 located behind the wall 2*a*. It can be also so designed that, as shown in FIG. 5, the air charging and discharging fan 6 is provided in the heating chamber 2, so that the external air is drawn thereinto through the air-charging opening 4. In the case of either of the above arrangements, the air thus charged is then circulated in the chamber 2 by the circulation fan 7 and is gradually discharged from the air discharging opening 5 toward the exhaust opening 10 made in the top surface of the cooking device main body 1**.

In the embodying example shown in FIG. 4, the heat source 11 comprising an electric heater is provided in the heating chamber 2, and the heating is carried out so that, in the case of cooking by heat by the operation thereof, the damper 12 provided to cover the exhaust opening 10 is closed so that discharge of smoke from the heating chamber 2 may be prevented.

Thus, according to this invention, in addition to the air charging and discharging fan 6 the circulation fan 7 for circulating air in the chamber is provided in the heating chamber 2, so that the external air charged thereinto from the air charging opening 4 made in the heating chamber 2 is circulated in the heating chamber 2 by the circulation fan 7 and is gradually discharged from the air discharging opening 5. Therefore, even where the air charging and the air discharging openings 4 and 5 are comparatively small in opening area, there can be produced the resultant air-current flowing substantially throughout the interior of the heating chamber 2. No water vapors remain in the chamber as a result of steaming from the foodstuffs being cooked, and the forming of waterdrops can be prevented as much as possible. Additionally, the circulation fan 7 is provided on the shaft **9*a* common to the air charging and discharging fan 6**, so that another driving source is not necessary; accordingly, the device can be simplified in construction and can be produced at a low price.

Accordingly, while there have been shown and described the preferred embodiment of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

I claim:

1. A microwave cooking device including a cooking device main body provided therein with (a) a heating chamber for receiving foodstuffs to be cooked, (b) a magnetron for irradiating microwaves onto the interior of the heating chamber and (c) an air charging and discharging fan for forcing air to charge into and to discharge from the heating chamber through an air charging opening and an air discharging opening disposed in the heating chamber, in which the improvement comprises:

A circulation fan separate from the air charging and discharging fan, said circulation fan being disposed within said heating chamber for circulation of air therein, thereby to prevent the accumulation of water vapor within said chamber, and said circulation fan being connected to a shaft common to such air charging and discharging fan.

2. A microwave cooking device as recited in claim 1, wherein a heat source comprising a gas burner is provided below the heating chamber so that cooking by heat may be also accomplished.

3. A microwave cooking device as recited in claim 1, wherein a heat source comprising an electric heater is provided in the heating chamber so that cooking by heat may be also accomplished.

4. A microwave cooking device as recited in claim 1, wherein the shaft comprises a motor shaft extending from an electric motor provided on the rear side of the cooking device main body and two fans are mounted thereon.

5. A microwave cooking device as recited in claim 1, wherein the air charging and discharging fan is provided in a fan casing attached to the outside of a rear wall of the heating chamber, and the air charging opening and the air discharging opening are made in the rear wall and are provided with respective guide members.

6. A microwave cooking device as recited in claim 2, wherein the air charging and discharging fan is interposed in an exhaust passage provided at the rear portion of the cooking device main body in order to permit additional use as an exhaust fan for combustion gas, and the air charging and air discharging openings are in communication with the exhaust passage through respective connecting tubes.

7. A microwave cooking device as recited in claim 1, wherein the air charging and discharging fan is provided in the heating chamber.

8. A microwave cooking device as recited in claim 2 or claim 3, wherein at least one of the air charging opening and the air discharging opening is provided with a damper arranged to be closed in the case of operation of the heat source.

9. A microwave cooking device as recited in claim 2 or claim 3, wherein an exhaust opening made in the top wall of the cooking device main body is provided with a damper arranged to be closed in the case of operation of the heat source.

10. A microwave cooking device as recited in claim 1, wherein the air discharging opening is composed of an insertion opening for inserting a member such as a temperature sensor or the like.

11. A microwave cooking device, comprising a heating chamber having wall means, the wall means having respective openings formed therein, a first fan outside of the heating chamber and on one side of the wall means for charging air into the heating chamber and discharging air therefrom through said respective openings, a second fan inside of the heating chamber and on the other side of the wall means for circulating air within the heating chamber, the first and second fans being separate and independent of each other, and means for driving said fans.

12. The microwave cooking device of claim 11, wherein said means for driving said fans comprises a motor having a shaft projecting through said wall means, and wherein said first and second fans are mounted coaxially on said motor shaft.

* * * * *